US007278865B1

(12) United States Patent
Su et al.

(10) Patent No.: US 7,278,865 B1
(45) Date of Patent: Oct. 9, 2007

(54) ELECTRONIC DEVICE WITH A GROUNDING MECHANISM

(75) Inventors: Shiau-Wei Su, Taichung (TW); Chien-Ming Hu, Tainan Hsien (TW); Hsiang-Lung Yu, Taichung Hsien (TW); Chun-Hsuan Shih, Changhua Hsien (TW)

(73) Assignee: Universal Scientific Industrial Co., Ltd. (TW)

( * ) Notice: Subject to any disclaimer, the term of this patent is extended or adjusted under 35 U.S.C. 154(b) by 0 days.

(21) Appl. No.: 11/470,814

(22) Filed: Sep. 7, 2006

(51) Int. Cl.
*H01R 4/66* (2006.01)

(52) U.S. Cl. ..... 439/92; 361/799

(58) Field of Classification Search ..... 439/92, 439/95; 361/799
See application file for complete search history.

(56) References Cited

U.S. PATENT DOCUMENTS 4,500,157 A * 2/1985 Huffnagle et al. ..... 439/391
4,755,147 A * 7/1988 Young ..... 439/77
4,826,442 A * 5/1989 Douty et al. ..... 439/92

* cited by examiner

*Primary Examiner*—Javaid H. Nasri
(74) *Attorney, Agent, or Firm*—Ostrolenk, Faber, Gerb & Soffen, LLP

(57) ABSTRACT

An electronic device includes: a conductive housing having an upright end wall formed with an opening; a mother board mounted in the conductive housing and having an end that is disposed adjacent to the upright end wall of the conductive housing, and a grounding trace that has a first end portion disposed adjacent to the end of the mother board, and a second end portion distal from the end of the mother board; a connector mounted on the mother board adjacent to the end of the mother board, extending through the opening in the upright end wall of the conductive housing, and having a grounding pin in electrical contact with the first end portion of the grounding trace; and a ground-bridging mechanism disposed adjacent to the first end portion of the grounding trace and bridging electrically the conductive housing and the first end portion of the grounding trace.

9 Claims, 11 Drawing Sheets

ELECTRONIC DEVICE WITH A GROUNDING MECHANISM

BACKGROUND OF THE INVENTION

1. Field of the Invention

This invention relates to an electronic device, more particularly to an electronic device with a grounding mechanism for fast removal of electromagnetic interference and electrostatic charges.

2. Description of the Related Art

FIG. 1 illustrates a conventional electronic device including a mother board 11 and a connector 13 mounted on the mother board 11. A grounding trace 12 is formed on the mother board 11, is in electrical contact with a grounding pin (not shown) of the connector 13, and has a distal end 121 distal from the connector 13 and in electrical contact with a screw 14 fastened to a conductive housing (not shown) of the electronic device, thereby establishing a grounding path 100 from the connector 13 to the conductive housing of the electronic device. However, the conventional electronic device is disadvantageous in that the grounding path 100 is relatively long, which results in slower in removal of electromagnetic interference and electrostatic charges on the connector 13.

SUMMARY OF THE INVENTION

Therefore, the object of the present invention is to provide an electronic device that can overcome the aforesaid drawback of the prior art.

According to this invention, there is provided an electronic device that comprises: a conductive housing having an upright end wall formed with an opening; a mother board mounted in the conductive housing and having an end that is disposed adjacent to the upright end wall of the conductive housing, and a grounding trace that has a first end portion disposed adjacent to the end of the mother board, and a second end portion distal from the end of the mother board; a connector mounted on the mother board adjacent to the end of the mother board, extending through the opening in the upright end wall of the conductive housing, and having a grounding pin in electrical contact with the first end portion of the grounding trace; and a ground-bridging mechanism disposed adjacent to the first end portion of the grounding trace and bridging electrically the conductive housing and the first end portion of the grounding trace.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
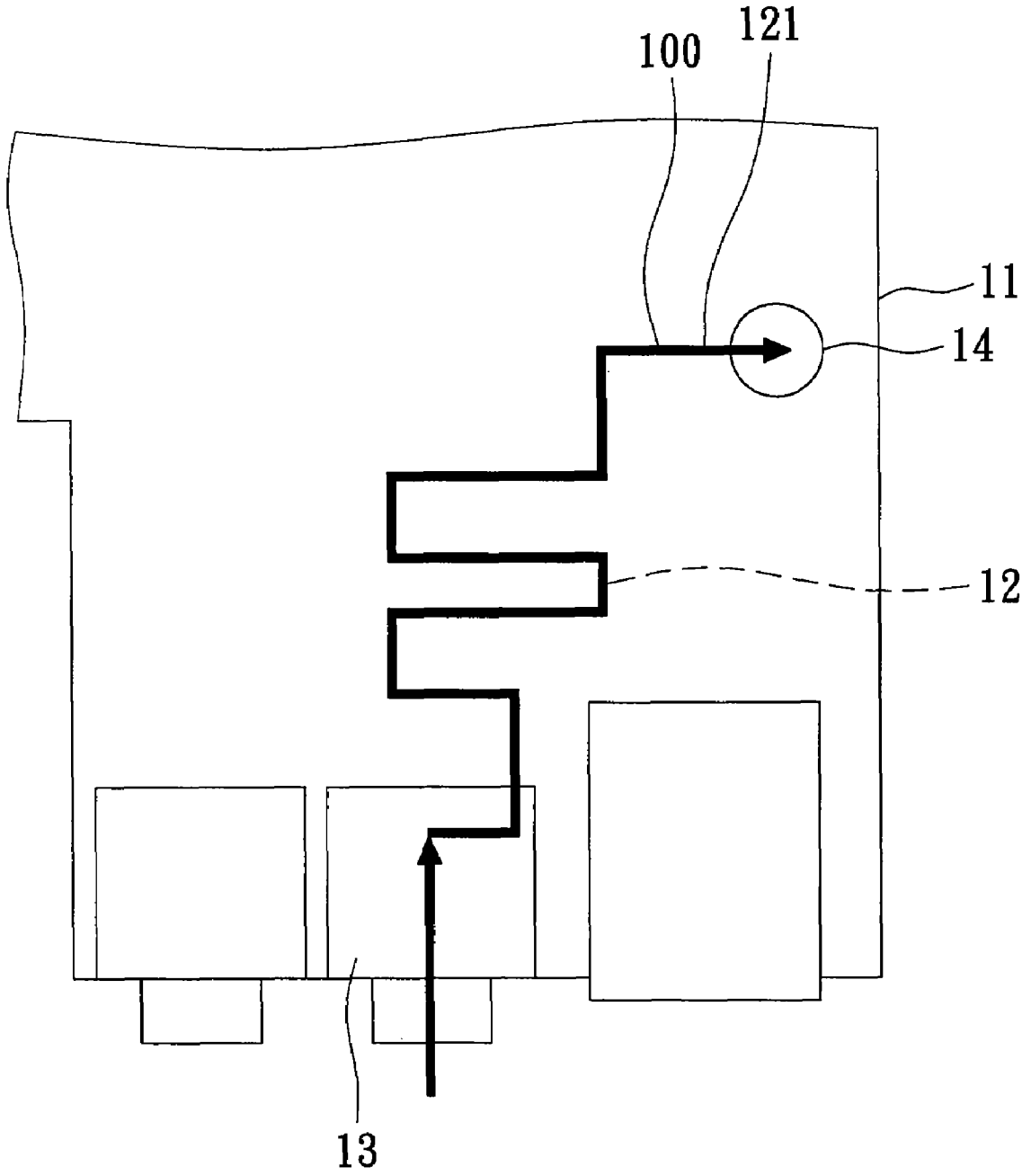
FIG. 1 PRIOR ART
FIG. 1 is a fragmentary schematic view of a conventional electronic device.

Before the present invention is described in greater detail with reference to the accompanying preferred embodiments, it should be noted herein that like elements are denoted by the same reference numerals throughout the disclosure.

Figure 2:
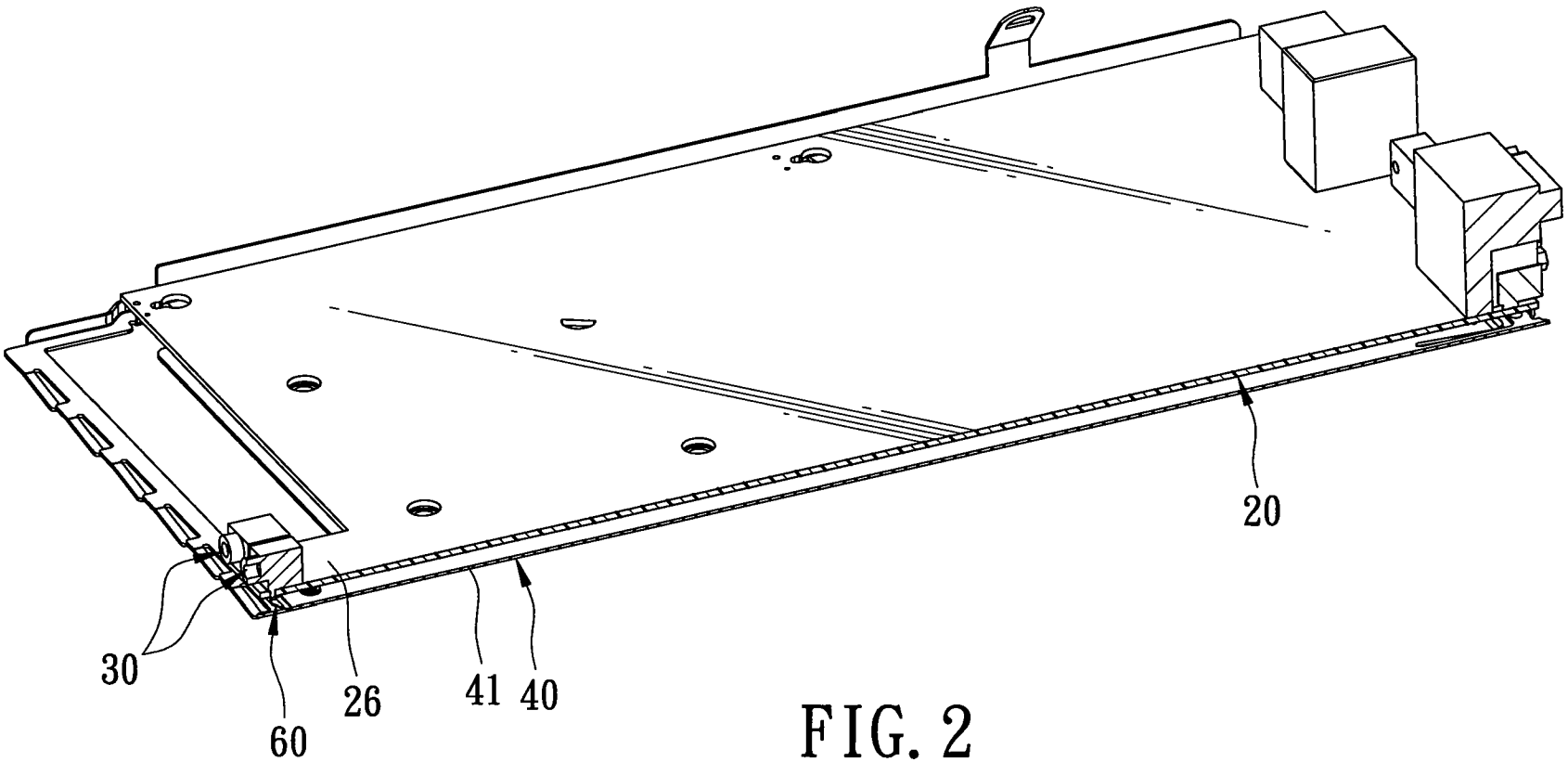
FIG. 2 is a perspective, partly sectional view of the first preferred embodiment of an electronic device according to this invention.
Figure 3:
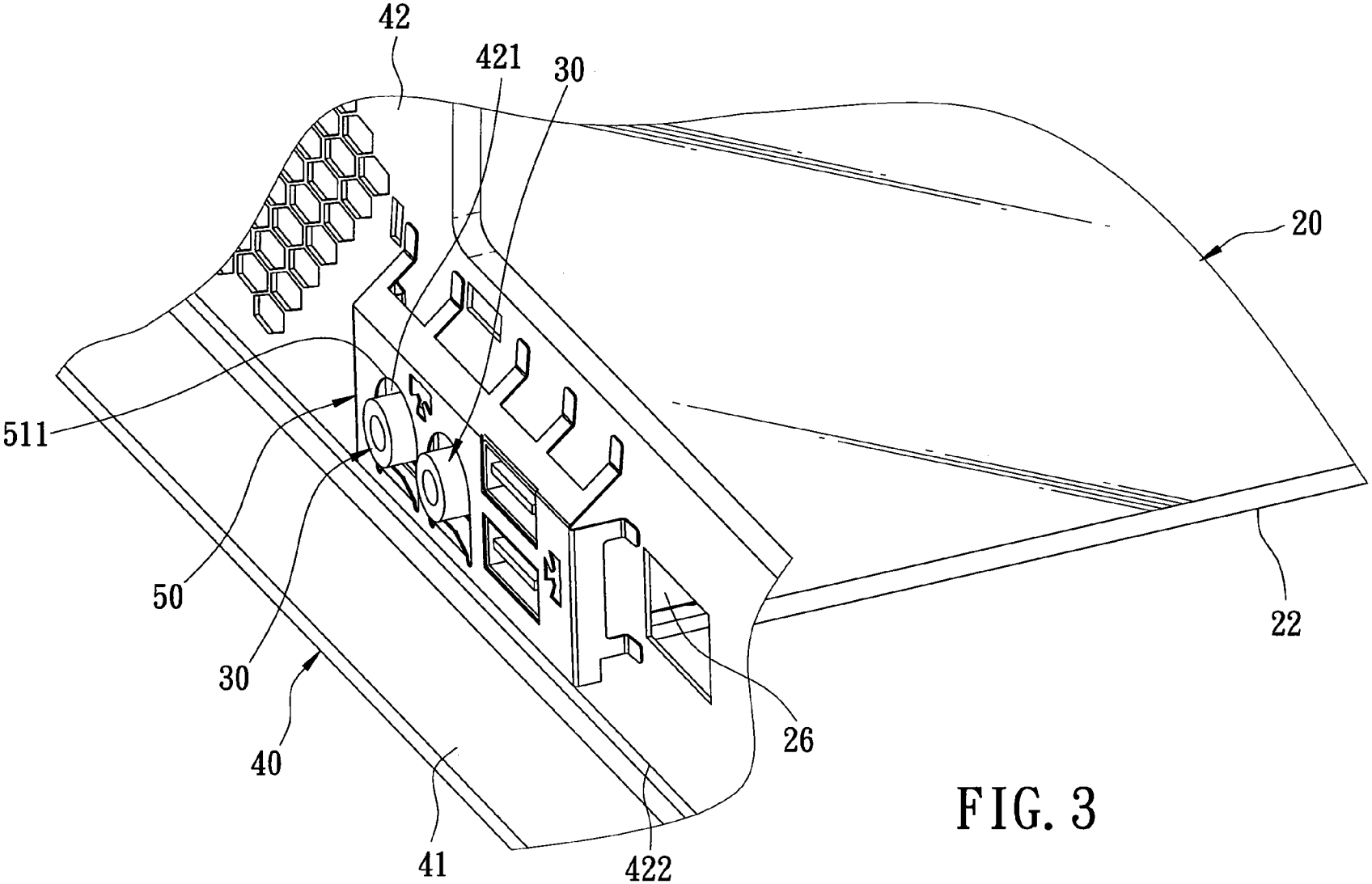
FIG. 3 is a fragmentary perspective view of the first preferred embodiment.
Figure 4:
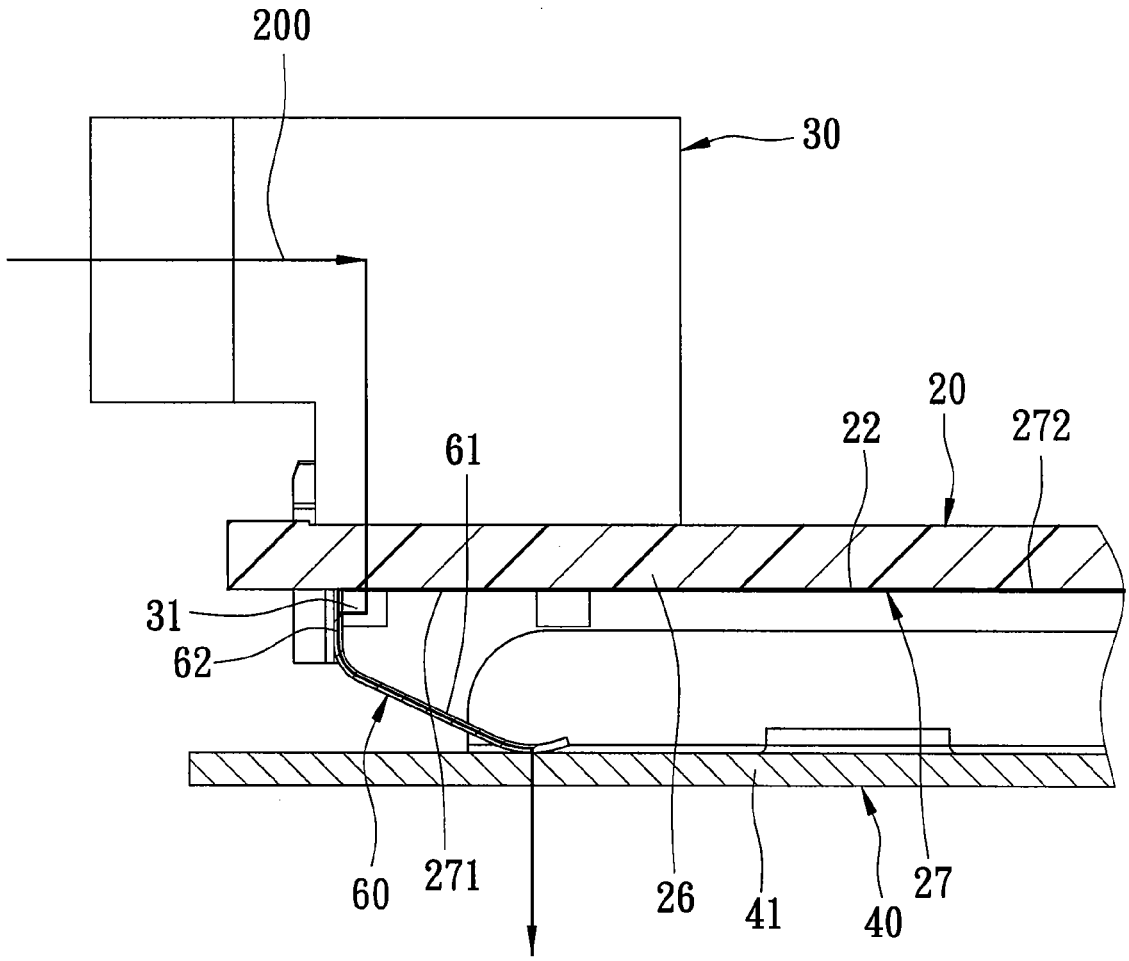
FIG. 4 is a fragmentary sectional view of the first preferred embodiment.

FIGS. 2 to 4 illustrate the first preferred embodiment of an electronic device according to this invention. The electronic device includes: a conductive housing 40 (see FIG. 3) having an upright end wall 42 formed with an opening 421; a mother board 20 mounted in the conductive housing 40 and having an end 26 that is disposed adjacent to the upright end wall 42 of the conductive housing 40, and a grounding trace 27 (see FIG. 4) that has a first end portion 271 disposed adjacent to the end 26 of the mother board 20, and a second end portion 272 distal from the end 26 of the motherboard 20; a connector 30 mounted on the mother board 20 adjacent to the end 26 of the mother board 20, extending through the opening 421 in the upright end wall 42 of the conductive housing 40, and having a grounding pin 31 in electrical contact with the first end portion 271 of the grounding trace 27; and a ground-bridging mechanism 60 disposed adjacent to the first end portion 271 of the grounding trace 27 and bridging electrically the conductive housing 40 and the first end portion 271 of the grounding trace 27, thereby establishing a grounding path 200 from the connector 30 to the conductive housing 40 of the electronic device.

In this embodiment, the upright end wall 42 of the conductive housing 40 has a lower end 422. The conductive housing 40 further has a board-mounting wall 41 transverse and connected to the lower end 422 of the upright end wall 42. The mother board 20 is mounted on the board-mounting wall 41. The grounding trace 27 is formed on a bottom surface of the mother board 20. The ground-bridging mechanism 60 has a first spring arm 61 that abuts resiliently against the board-mounting wall 41, and a trace-connecting plate 62 that is bent from the first spring arm 61 and that is soldered to the first end portion 271 of the grounding trace 27. A metal shield 50 is mounted on the upright end wall 42 of the conductive housing 40, and is formed with a through-hole 511 that is registered with the opening 421 in the upright end wall 42 for extension of the connector 30 therethrough.

Figure 5:
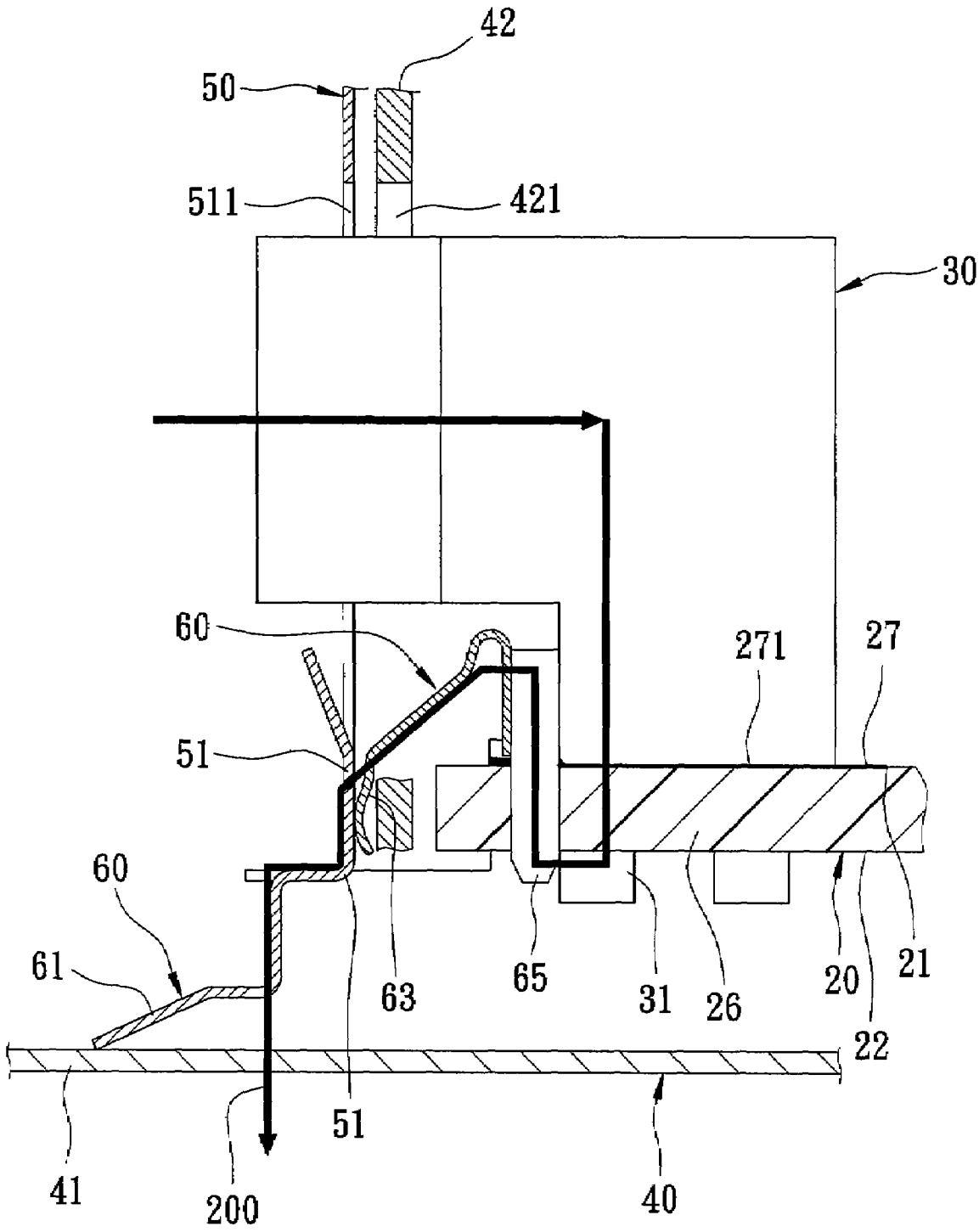
FIG. 5 is a fragmentary sectional view of the second preferred embodiment of the electronic device according to this invention.
Figure 6:
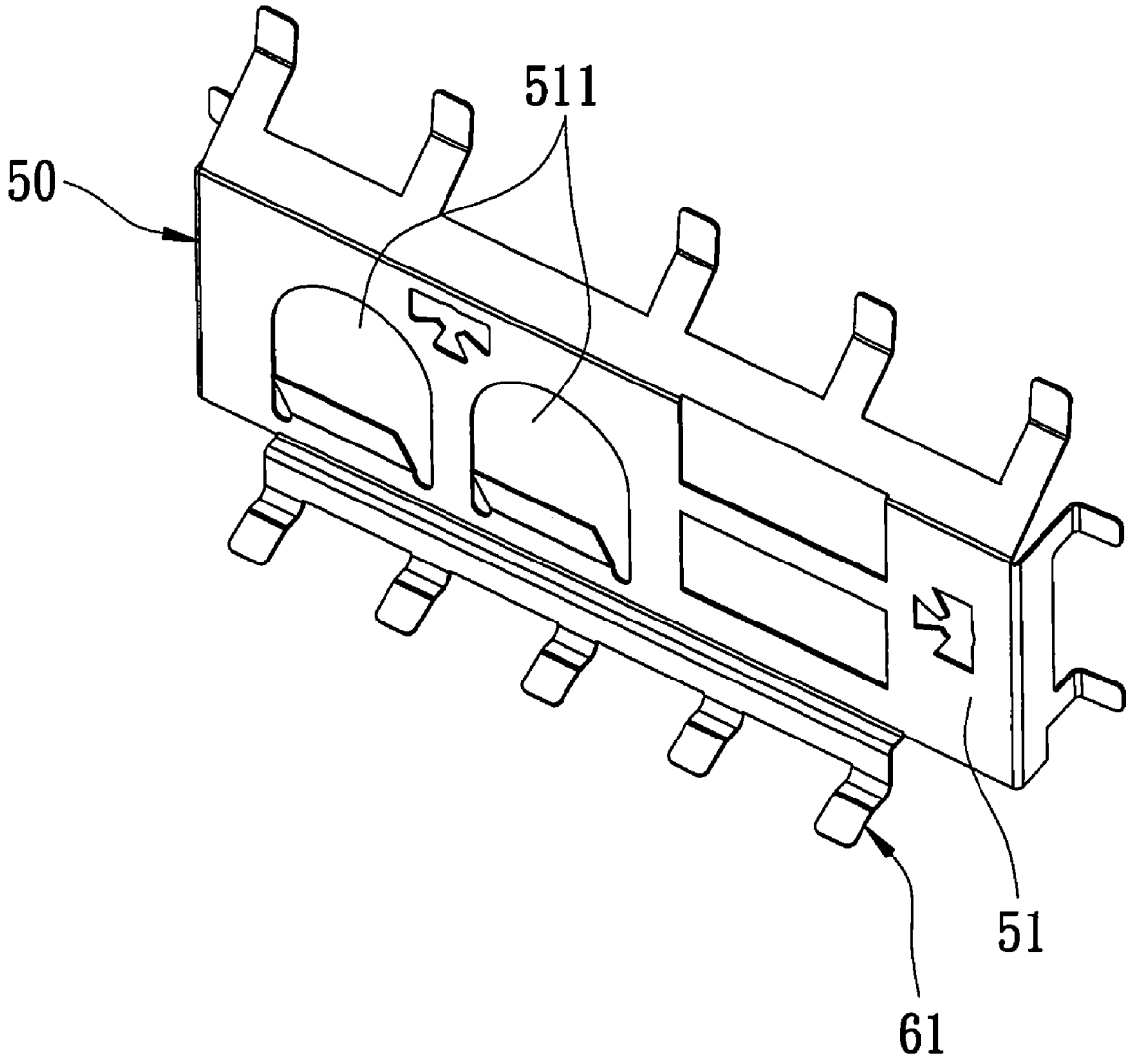
FIG. 6 is a perspective view of a metal shield of the second preferred embodiment.
Figure 7:
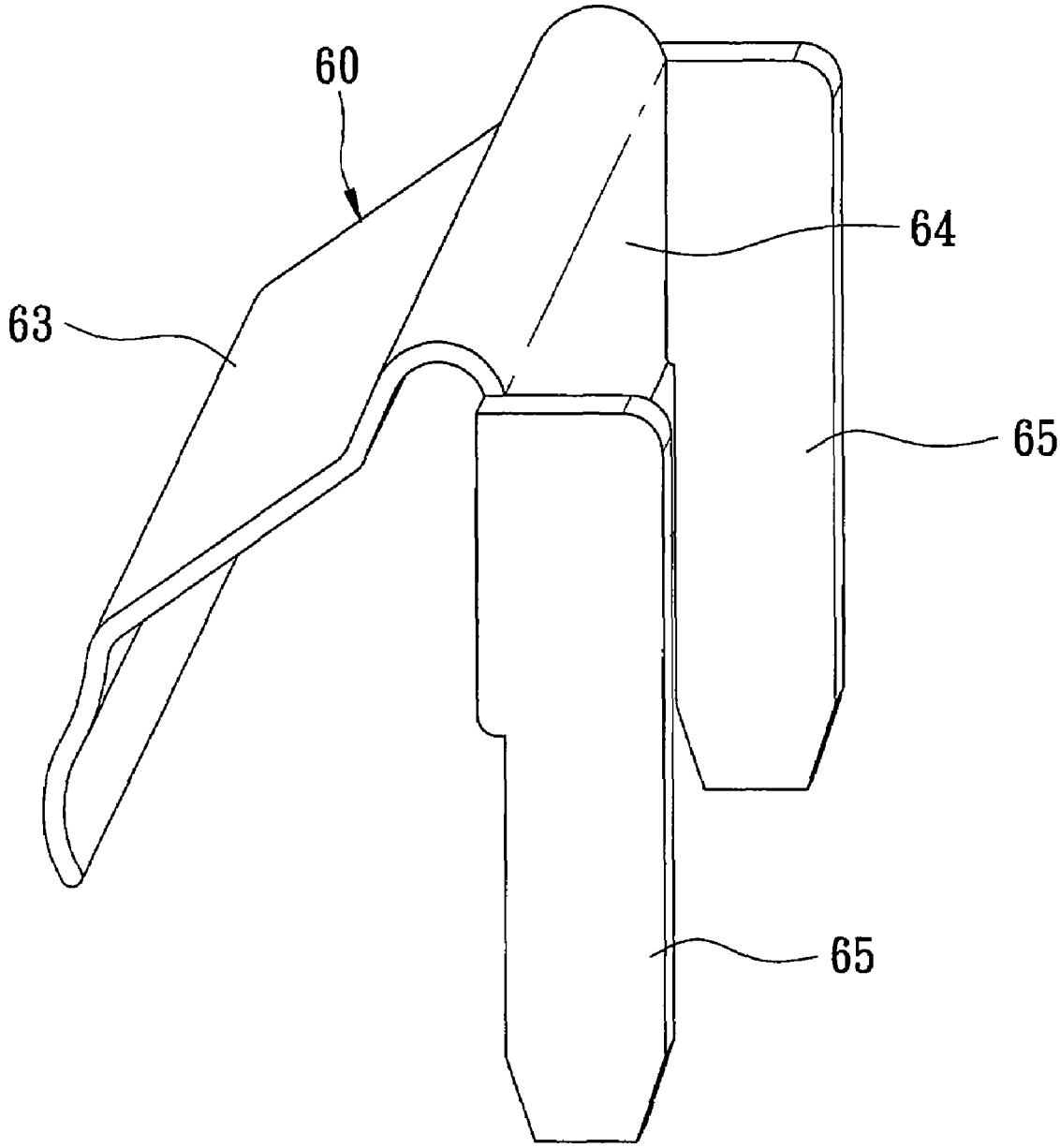
FIG. 7 is a perspective view of a part of a ground-bridging mechanism of the second preferred embodiment.
Figure 8:
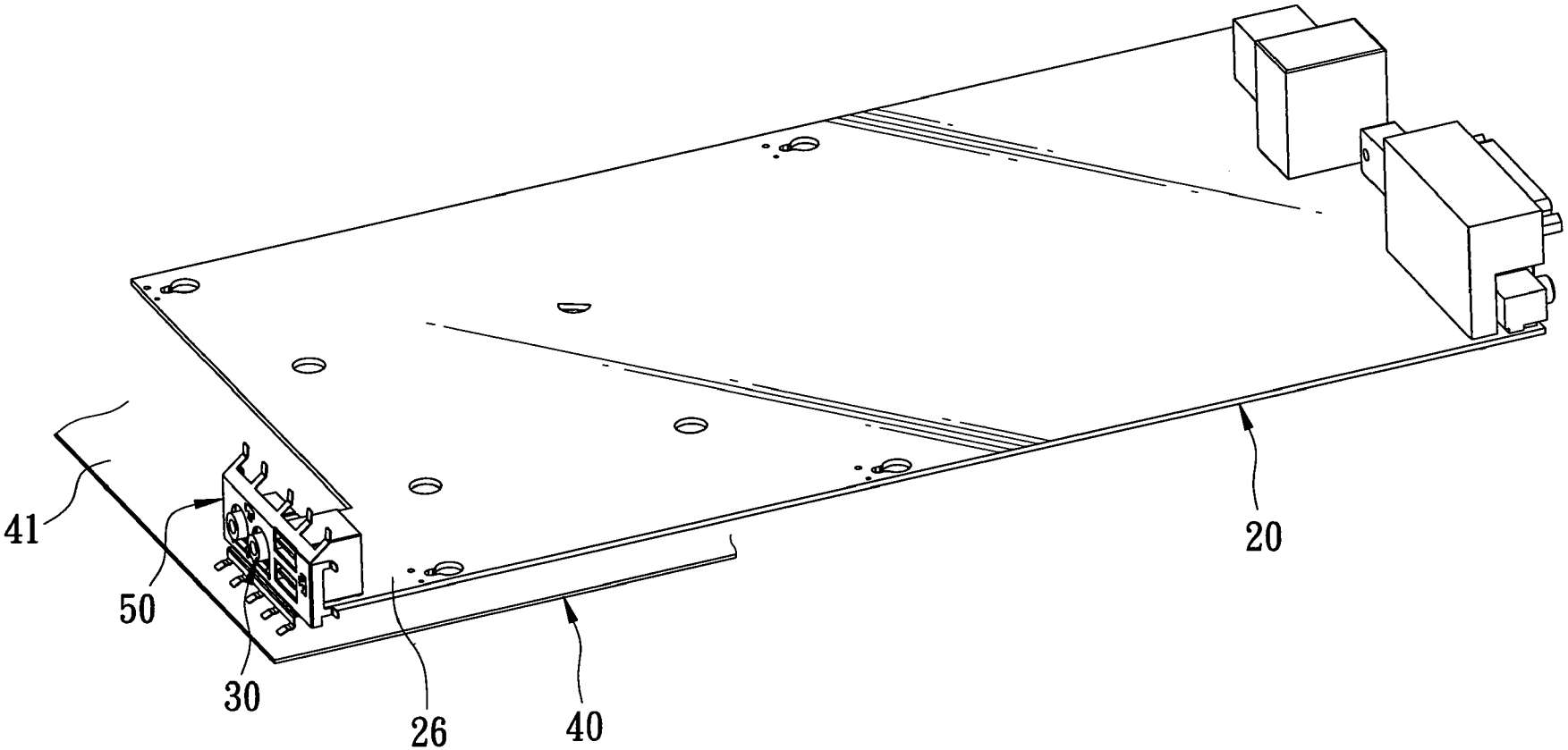
FIG. 8 is a fragmentary perspective view of the third preferred embodiment of the electronic device according to this invention.
Figure 9:
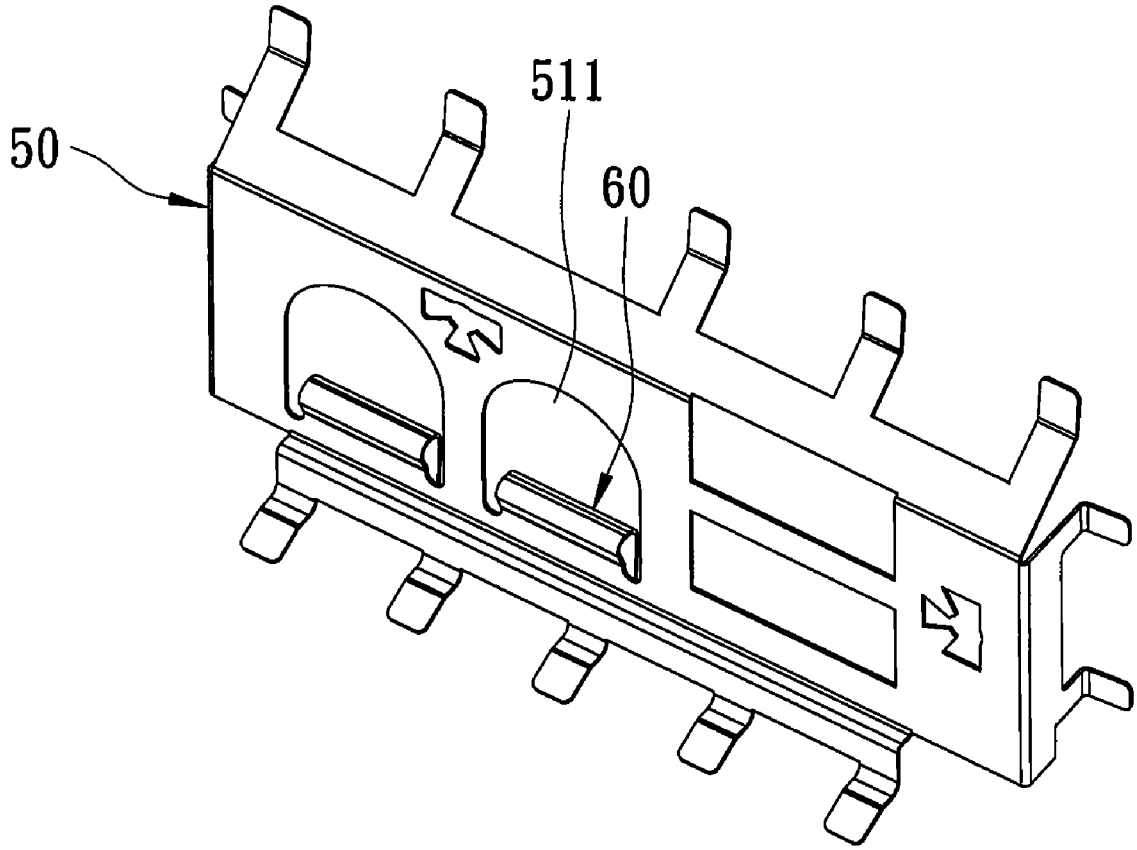
FIG. 9 is a perspective view of a metal shield of the third preferred embodiment.
Figure 10:
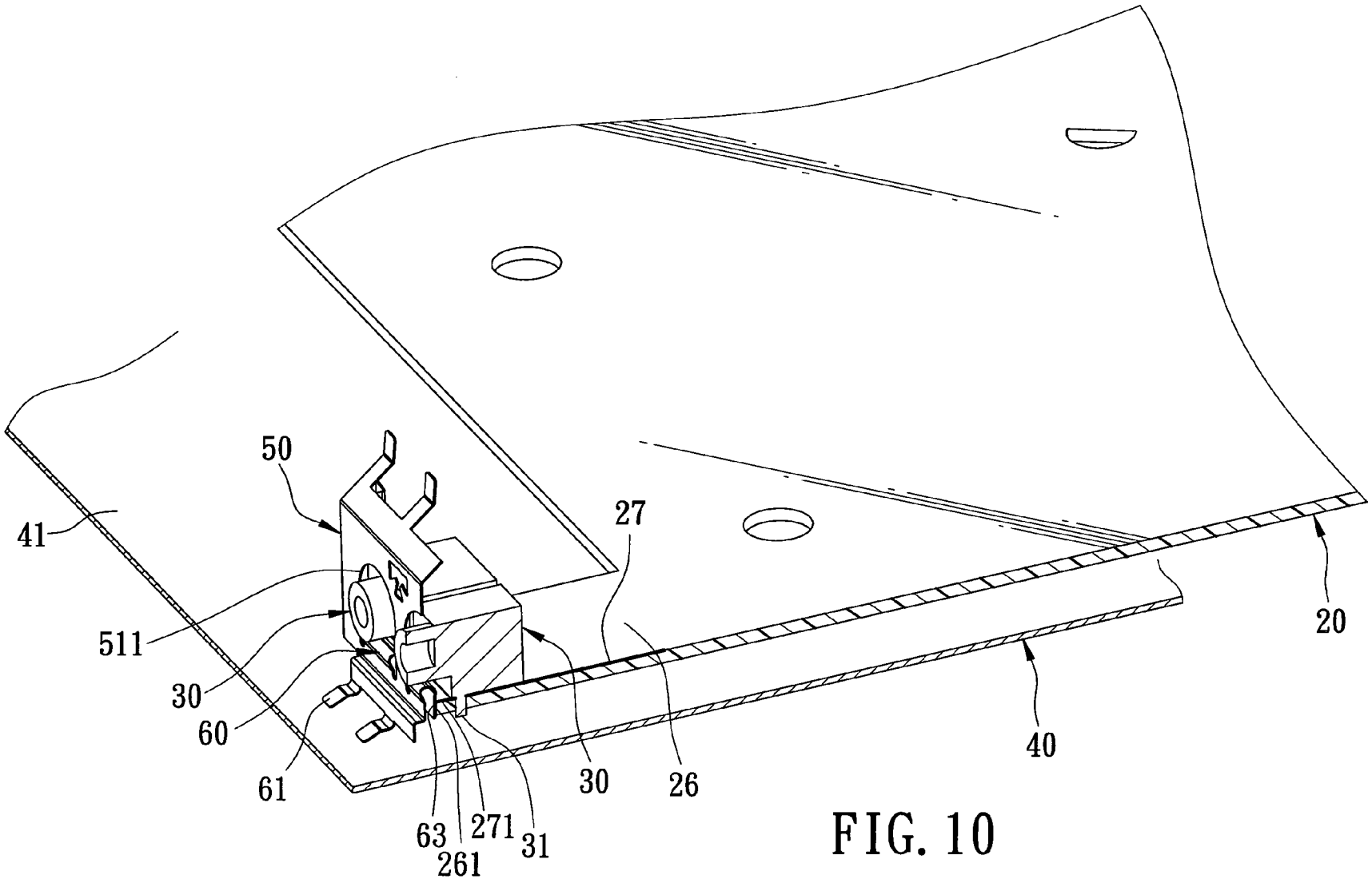
FIG. 10 is a perspective, partly sectional view of the third preferred embodiment.
Figure 11:
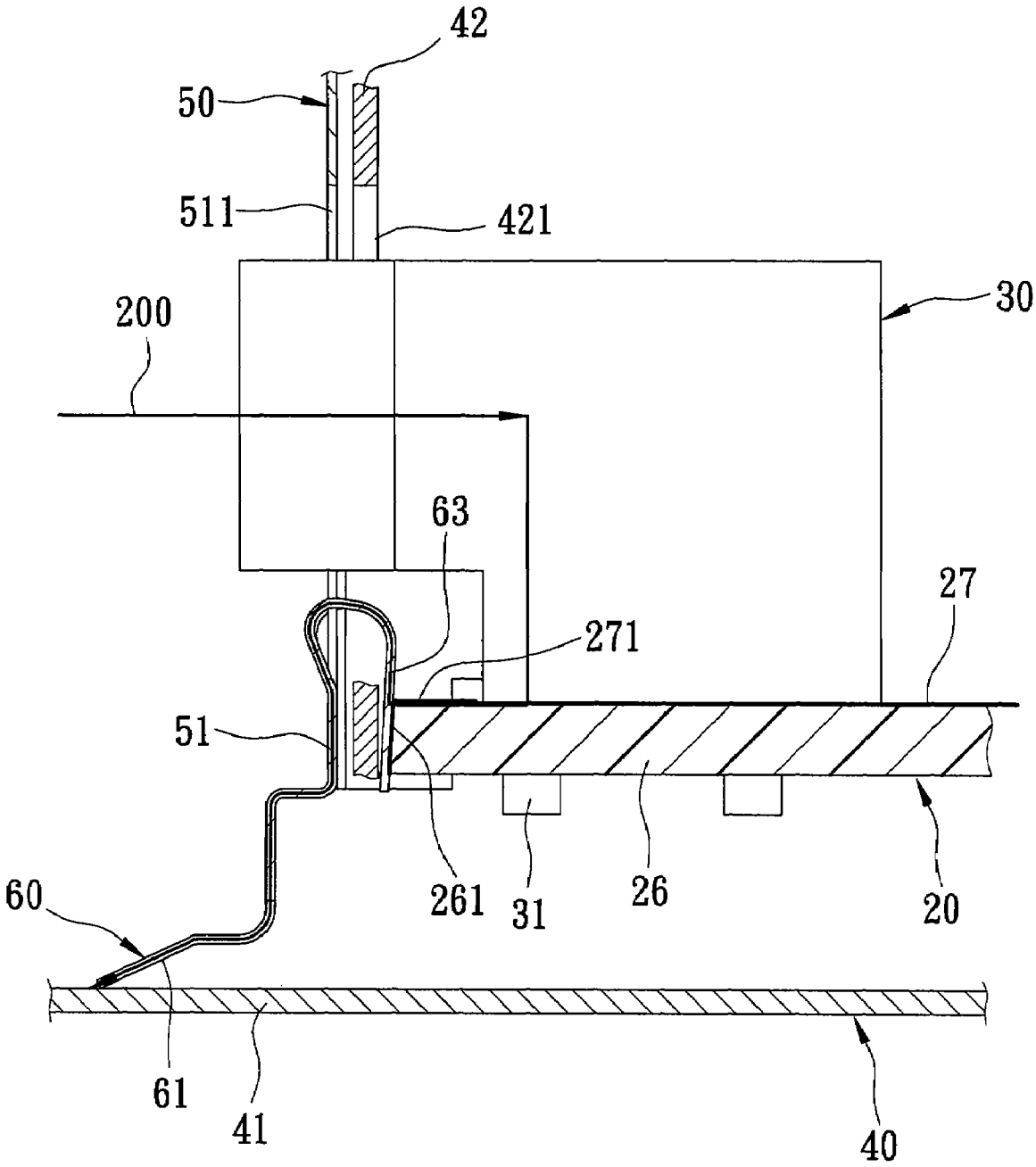
FIG. 11 is a fragmentary sectional view of the third preferred embodiment.

FIGS. 5 to 7 illustrate the second preferred of the electronic device according to this invention. The electronic device of this embodiment differs from the previous embodiment in that the first spring arm 61 of the ground-bridging mechanism 60 extends from a lower end 51 of the metal shield 50 to an end portion of the board-mounting wall 41 of the conductive housing 40. The grounding trace 27 is formed on an upper surface 21 of the mother board 20 in this embodiment.

In this embodiment, the ground-bridging mechanism 60 further has a second spring arm 63 that abuts resiliently against the lower end 51 of the metal shield 50, a fixed plate 64 bent from the second spring arm 63, and two opposite wings 65 extending respectively from two opposite sides of the fixed plate 64 through the mother board 20. At least one of the wings 65 contacts electrically the first end portion 271 of the grounding trace 27 through a solder. The grounding path 200 of this embodiment travels from the connector 30 through the first end portion 271 of the grounding trace 27, one of the wings 65, the fixed plate 64, the lower end 51 of the metal shield 50 and the first spring arm 61 to the board-mounting wall 41 of the conductive housing 40.

FIGS. 8 to 11 illustrate the third preferred embodiment of the electronic device according to this invention. The electronic device of this embodiment differs from the second preferred embodiment in that the second spring arm 63 is formed by cutting a portion of the metal shield 50, which forms the through-hole 511, and by bending the portion of the metal shield 50 toward the end 26 of the mother board 20. The second spring arm 63 extends through the opening 421 in the upright end wall 42 of the conductive housing 40, and abuts resiliently against the first end portion 271 of the conductive trace 27.

In this embodiment, the end 26 of the mother board 20 has an end face 261 facing the upright end wall 42 of the conductive housing 40. The first end portion 271 of the conductive trace 27 extends to and covers the end face 261 of the end 26 of the mother board 20. The grounding path 200 of this embodiment travels from the connector 30 through the first end portion 271 of the grounding trace 27, the second spring arm 63, the lower end 51 of the metal shield 50, and the first spring arm 61 to the board-mounting wall 41 of the conductive housing 40.

Since the grounding path 200 travels from the connector 30 through the first end portion 271 of the grounding trace 27 to a nearby portion of the conductive housing 40, and does not travel to the second end portion 272 of the grounding trace 27, the length thereof is much shorter than that of the grounding path 100 of the aforesaid conventional electronic device, thereby improving removal of electromagnetic interference and electrostatic charges on the connector 30.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. An electronic device comprising:

a conductive housing having an upright end wall formed with an opening;

a mother board mounted in said conductive housing and having an end that is disposed adjacent to said upright end wall of said conductive housing, and a grounding trace that has a first end portion disposed adjacent to said end of said mother board;

a connector mounted on said mother board adjacent to said end of said mother board, extending through said opening in said upright end wall of said conductive housing, and having a grounding pin in electrical contact with said first end portion of said grounding trace; and aground-bridging mechanism disposed adjacent to said first end portion of said grounding trace and bridging electrically said conductive housing and said first end portion of said grounding trace.

2. The electronic device of claim 1, wherein said ground-bridging mechanism has a first spring arm that abuts resiliently against said conductive housing.

3. The electronic device of claim 2, wherein said upright end wall of said conductive housing has a lower end, said conductive housing further having a board-mounting wall transverse and connected to said lower end of said upright end wall, said mother board being mounted on said board-mounting wall, said first spring arm abutting resiliently against said board-mounting wall.

4. The electronic device of claim 2, wherein said ground-bridging mechanism further has a trace-connecting plate that is bent from said first spring arm and that is soldered to said first end portion of said grounding trace.

5. The electronic device of claim 2, further comprising a metal shield mounted on said upright end wall of said conductive housing and formed with a through-hole that is registered with said opening in said upright end wall for extension of said connector therethrough, said metal shield having a lower end, said first spring arm of said ground-bridging mechanism extending from said lower end of said metal shield to said conductive housing.

6. The electronic device of claim 5, wherein said upright end wall of said conductive housing has a lower end, said conductive housing further having a board-mounting wall transverse and connected to said lower end of said upright end wall, said first spring arm of said ground-bridging mechanism extending from said lower end of said metal shield to said board-mounting wall of said conductive housing.

7. The electronic device of claim 5, wherein said ground-bridging mechanism further has a second spring arm that abuts resiliently against said lower end of said metal shield, a fixed plate bent from said second spring arm, and at least one wing extending from said fixed plate through said mother board to contact electrically said first end portion of said grounding trace.

8. The electronic device of claim 5, wherein said ground-bridging mechanism further has a second spring arm that is formed by cutting a portion of said metal shield and by bending said portion of said metal shield toward said end of said mother board, said second spring arm extending through said opening in said upright end wall of said conductive housing, and abutting resiliently against said first end portion of said conductive trace.

9. The electronic device of claim 8, wherein said end of said mother board has an end face facing said upright end wall of said conductive housing, said first end portion of said conductive trace extending to and covering said end face of said end of said mother board.

* * * * *